US010046226B2

(12) United States Patent
Pitlyk

(10) Patent No.: US 10,046,226 B2
(45) Date of Patent: Aug. 14, 2018

(54) PERSONAL SIGNAL DEVICE TO BE USED FOR WATER SPORTS

(71) Applicant: DownAlert PSD, LLC, Lake St. Louis, MO (US)

(72) Inventor: Denise Pitlyk, Lake St. Louis, MO (US)

(73) Assignee: Downalert PSD, LLC, St. Louis, MO (US)

( * ) Notice: Subject to any disclaimer, the term of this patent is extended or adjusted under 35 U.S.C. 154(b) by 44 days.

(21) Appl. No.: 15/345,939

(22) Filed: Nov. 8, 2016

(65) Prior Publication Data

US 2018/0126246 A1 May 10, 2018

(51) Int. Cl.
*A63B 71/06* (2006.01)

(52) U.S. Cl.
CPC ..... *A63B 71/06* (2013.01); *A63B 2071/0694* (2013.01); *A63B 2208/03* (2013.01)

(58) Field of Classification Search
CPC ..... A63B 71/06; A63B 2071/0694; A63B 2208/03
USPC ..... 116/26, 173, 200, 201, 209, 210, 278, 116/DIG. 7–DIG. 9; 40/212, 586, 602
See application file for complete search history.

(56) References Cited

U.S. PATENT DOCUMENTS 361,250 A * 4/1887 Wright ..... A41D 19/0041 2/125
689,840 A 12/1901 Jensen
1,504,836 A * 8/1924 Belden ..... A41D 19/002 2/160
1,624,429 A 4/1927 Palmer
1,630,730 A * 5/1927 Daugherty ..... G08B 5/02 116/35 R
1,670,176 A 5/1928 Woolery
1,772,305 A * 8/1930 Chamberland ..... F21L 15/06 116/35 R
1,982,431 A * 11/1934 Hines ..... A41D 19/002 2/160
2,223,029 A 11/1940 Dunton
2,534,313 A * 12/1950 Starkey ..... G08B 5/02 116/200
2,581,549 A * 1/1952 McGaugh ..... A41D 19/0157 116/28 R
3,946,699 A 3/1976 Mirshak
3,952,694 A * 4/1976 McDonald ..... B63B 45/00 114/311
4,138,745 A * 2/1979 Greenspan ..... A41D 11/00 2/247
4,297,746 A * 11/1981 Zarbos ..... A41D 3/00 2/108
4,598,661 A 7/1986 Roe
4,752,264 A 6/1988 Melendez et al.
4,756,027 A * 7/1988 Buenos ..... A41D 19/0041 2/123
4,850,052 A * 7/1989 Matthews ..... A41D 19/0024 2/160

(Continued)

*Primary Examiner* — R. A. Smith
*Assistant Examiner* — Tania Courson
(74) *Attorney, Agent, or Firm* — Joseph M. Rolnicki; Evans & Dixon, L.L.C.

(57) ABSTRACT

A personal signal device can be worn on an arm of a water sport participant and includes a signal flag that is stowed in a pouch of the device and can be removed from the pouch and manually waved by the water sport participant when the water sport participant is in the water.

17 Claims, 5 Drawing Sheets

(56) References Cited

U.S. PATENT DOCUMENTS 5,001,455 A * 3/1991 Starchevich ..... G08B 5/006 200/61.58 R
5,067,920 A 11/1991 Brisky
5,114,369 A 5/1992 Coffey
5,421,287 A * 6/1995 Yonover ..... B63C 9/21 116/209
5,651,711 A 7/1997 Samano
5,671,480 A * 9/1997 Krout ..... A41D 13/0125 116/173
5,706,521 A * 1/1998 Haney ..... A41D 19/0024 2/160
5,839,931 A * 11/1998 Shieh ..... B63B 22/22 441/30
D422,397 S 4/1999 Cohen
5,924,136 A * 7/1999 Ogean ..... A45C 1/04 2/159
6,033,275 A 3/2000 Ely
6,058,510 A 5/2000 Breitenbach
6,405,381 B1 * 6/2002 Bowman, Jr. ..... A41D 19/0051 2/159
6,412,482 B1 * 7/2002 Rowe ..... A62B 7/02 128/200.24
6,505,575 B1 * 1/2003 Ciari ..... A63B 29/021 116/209
6,749,473 B1 6/2004 Lower
6,789,496 B2 * 9/2004 Gehris ..... G09F 17/00 116/173
6,938,275 B1 9/2005 Fried
7,003,810 B2 * 2/2006 Goldkind ..... A41D 11/00 2/227
D570,246 S 6/2008 Spicer
7,434,271 B2 * 10/2008 Klayman-Grodsky ..... A41D 11/00 2/244
7,520,074 B1 4/2009 Vanova
7,574,973 B2 * 8/2009 Markham ..... A63B 29/021 116/201
D607,183 S 1/2010 Stumpfl
7,665,412 B2 * 2/2010 Walls ..... G09F 17/00 116/173
7,690,322 B2 * 4/2010 Lanh ..... G09F 21/02 116/173
8,191,172 B2 * 6/2012 Polanish ..... A41D 13/0015 2/244
8,832,868 B2 * 9/2014 Owen ..... A41D 27/08 2/244
8,858,285 B1 * 10/2014 Wheatley ..... B63C 9/115 441/84
8,910,314 B2 * 12/2014 Hefter ..... A41D 11/00 2/247
9,371,118 B2 6/2016 King et al.
9,646,520 B2 * 5/2017 Mokros ..... G09F 17/00
2004/0221372 A1 * 11/2004 Zborovsky-Fenster ..... A41D 11/00 2/250
2006/0217027 A1 * 9/2006 Martuccio ..... A41D 13/0015 446/46
2007/0169682 A1 7/2007 Boyd
2009/0298378 A1 * 12/2009 Segal ..... A63J 7/005 446/26
2011/0100289 A1 * 5/2011 Birkin ..... B63C 9/04 116/210

* cited by examiner

PERSONAL SIGNAL DEVICE TO BE USED FOR WATER SPORTS

FIELD

This disclosure pertains to a personal signal device that can be used while participating in water sports. More specifically, this disclosure pertains to a signaling device that can be worn on an arm of a water sport participant that includes a signal flag that can be dispensed from the device and manually waved by a water sport participant to attract the attention of others to the location of the water sport participant in the water.

BACKGROUND

Known signal devices, for example water skier down signaling devices are typically kept on a boat pulling the water skier and are displayed when the water skier goes down in the water. An example of these is an orange signal flag kept on the boat pulling the water skier. When the water skier goes down in the water, a person on the boat waves the signal flag as the boat returns to the down water skier to signal other boats in the area that a water skier is down in the water.

A disadvantage of this type of signal device is that it is kept on the boat pulling the water skier and can be some distance from the water skier when the water skier goes down in the water. Thus, the signal device signals other boats in the area that a water skier is down in the water, but does not provide information on the location of the water skier down in the water. The signal device on the boat may actually distract attention away from the water skier down in the water.

SUMMARY

The personal signal device used for water sports of this disclosure is basically comprised of a flexible sleeve that can be comfortably worn on the arm of a water sport participant, a pouch on the sleeve and a signal flag inside the pouch. While participating in a water sport, for example swimming, tubing, riding a wave runner or water skiing, the water skier wears the sleeve on either arm with the signal flag stowed in the pouch on the sleeve. When the water skier goes down in the water, the water skier can use one hand to pull the signal flag from the pouch worn on the arm of their other hand, insert their other hand into a pocket on the signal flag and then wave the signal flag over their head to attract the attention of other boaters in the area of the downed water skier.

In one embodiment of the water skier down signaling device, the sleeve is at least partially constructed of an elastic material. The elastic material enables the sleeve to expand as the water skier inserts their arm into the sleeve and then contract around the water skier's arm to securely hold the signaling device on the arm of the water skier.

In a further embodiment of the water skier down signaling device, the sleeve is constructed with fasteners, for example hook and loop type fasteners. The fasteners can be opened to convert a tubular configuration of the sleeve to a sheet configuration. The sheet configuration of the sleeve is then wrapped around the arm of the water skier and the fasteners reattached, securing the water skier down signaling device to the arm of the water skier.

While the personal signal device is described above as being used by a water skier, the signal device can be used by any participant in water sports. The personal signal device could be used by a swimmer in a swimming pool to attract the attention of a lifeguard if the swimmer is having trouble. The personal signal device could also be used by a person that is tubing behind a boat, a person that is operating a wave runner, or a person that is participating in any type of water sport or water involved activity. It should be understood that the personal signal device of this disclosure should not be interpreted as only being usable by a water skier.

BRIEF DESCRIPTION OF THE DRAWINGS

Further features of the personal signal device to be used for water sports are set forth in the following detailed description of the device and the drawing figures.

DESCRIPTION

Figure 1:
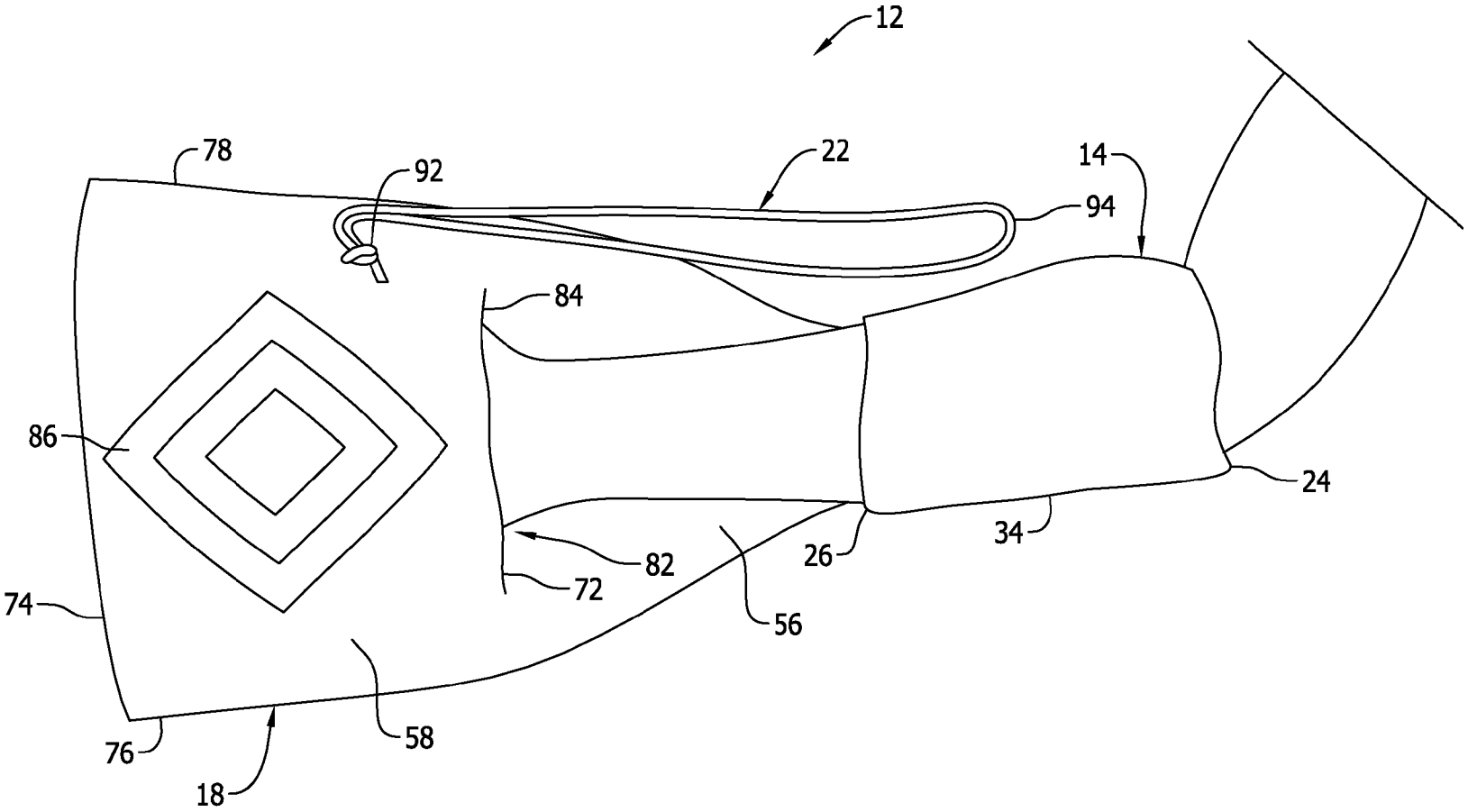
FIG. 1 is a representation of the personal signal device worn on the arm of a water sport participant.
Figure 2:
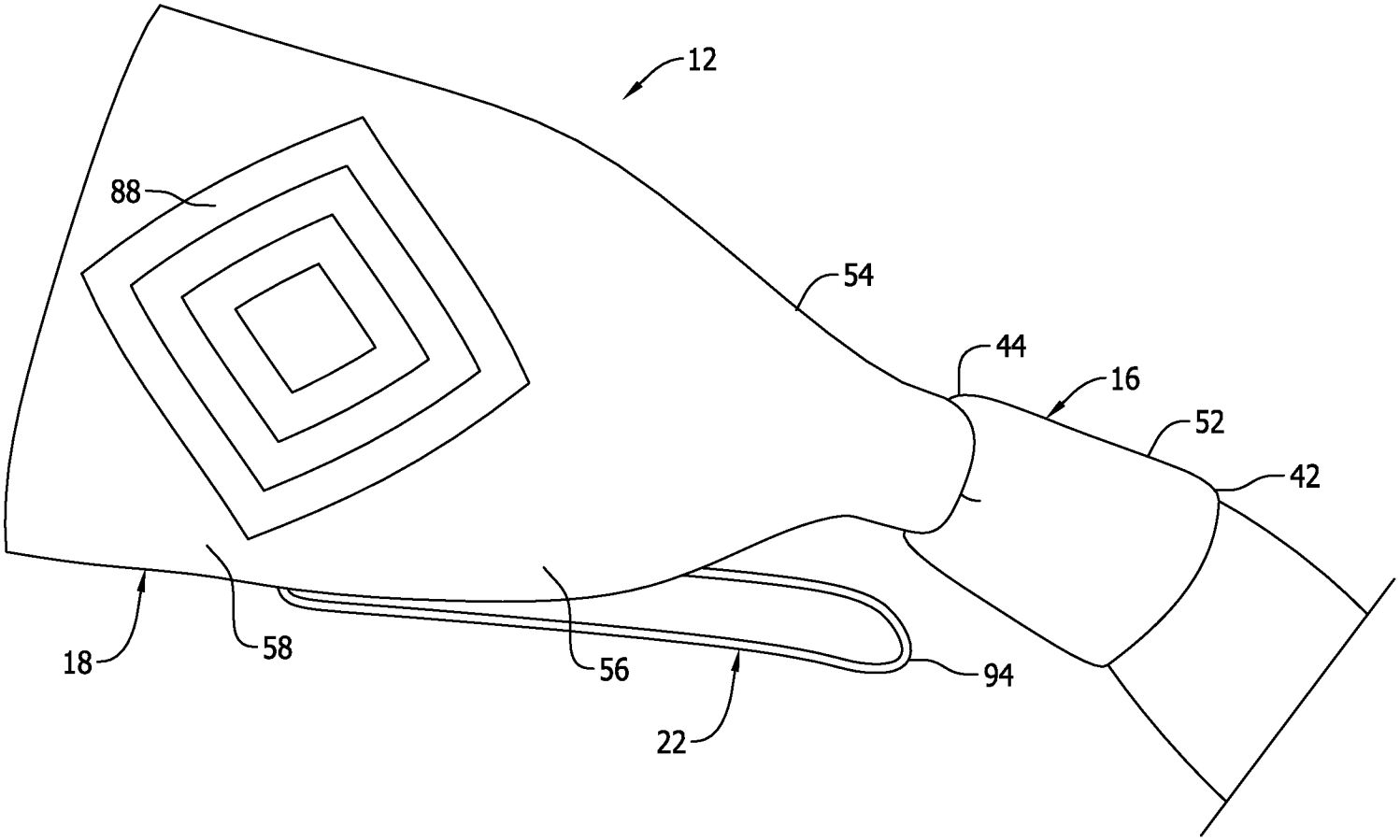
FIG. 2 is a representation of the opposite side of the signal device represented in FIG. 1.
Figures 3, 4:
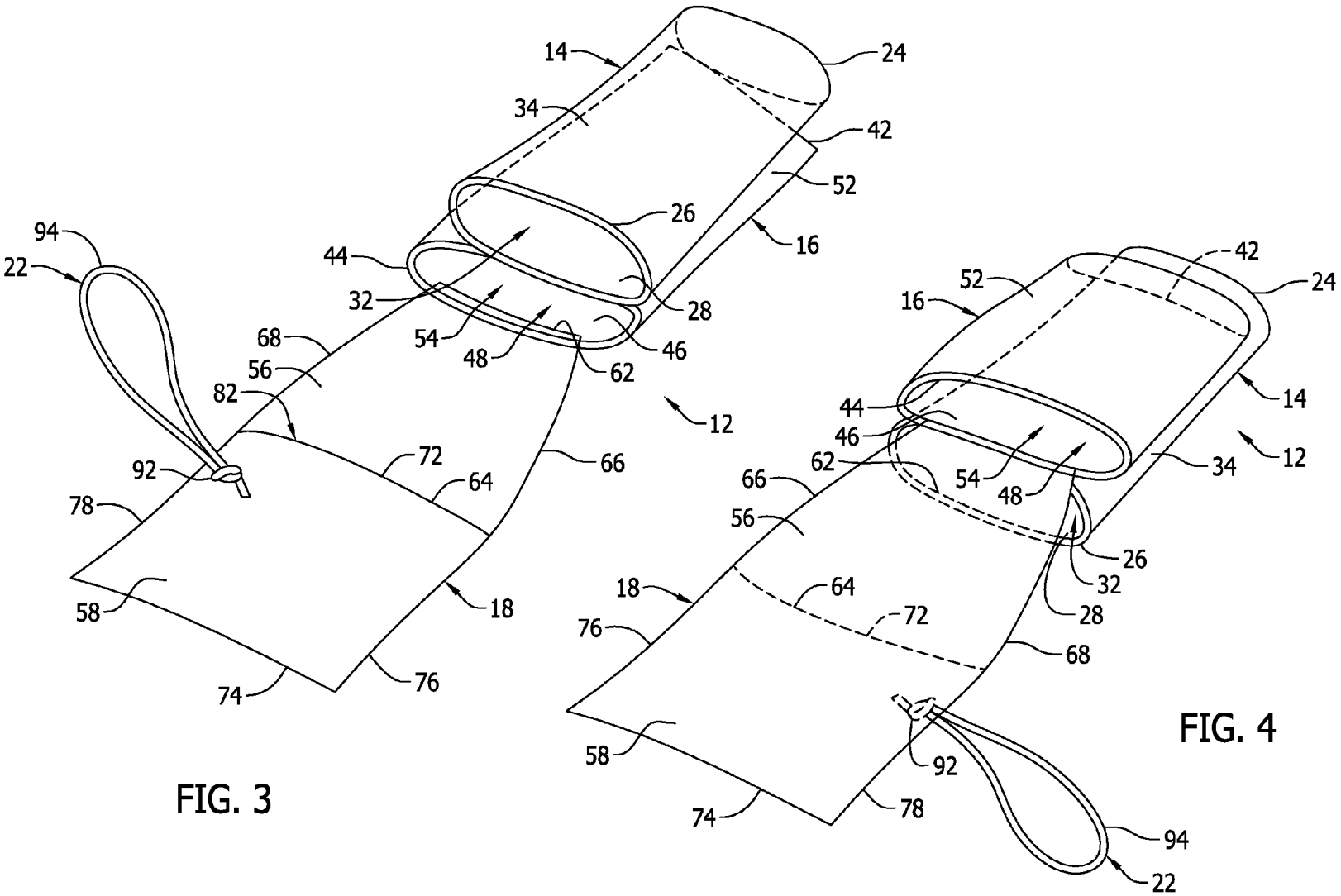
FIG. 3 is a representation of a perspective view of the signal device in its deployed condition.
FIG. 4 is a representation of a perspective view of the signal device rolled over 180° from its position in FIG. 3.
Figure 6:
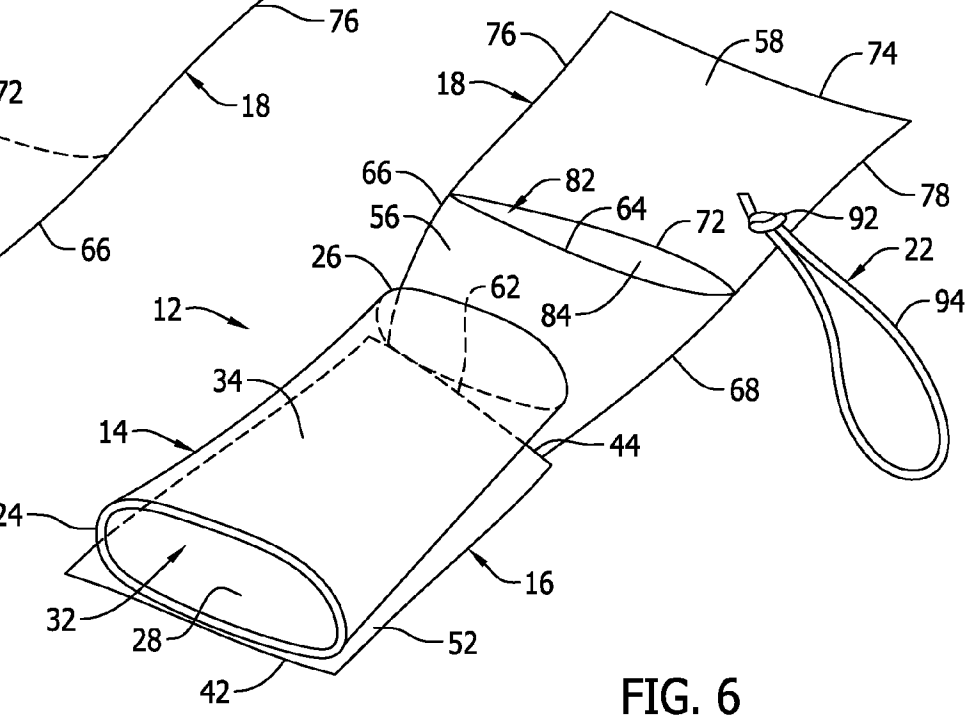
FIG. 6 is a representation of a perspective view of the signal device rolled over 180° from its position in FIG. 5.
Figure 5:
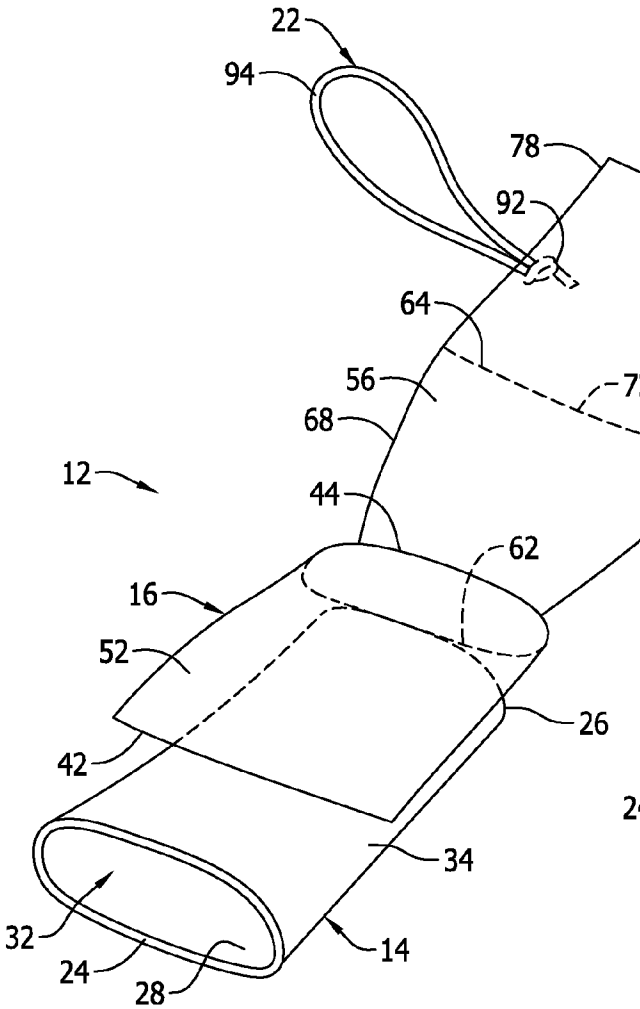
FIG. 5 is a representation of a perspective view of the opposite side of the signal device flipped over 180° from its position in FIG. 4.
Figure 8:
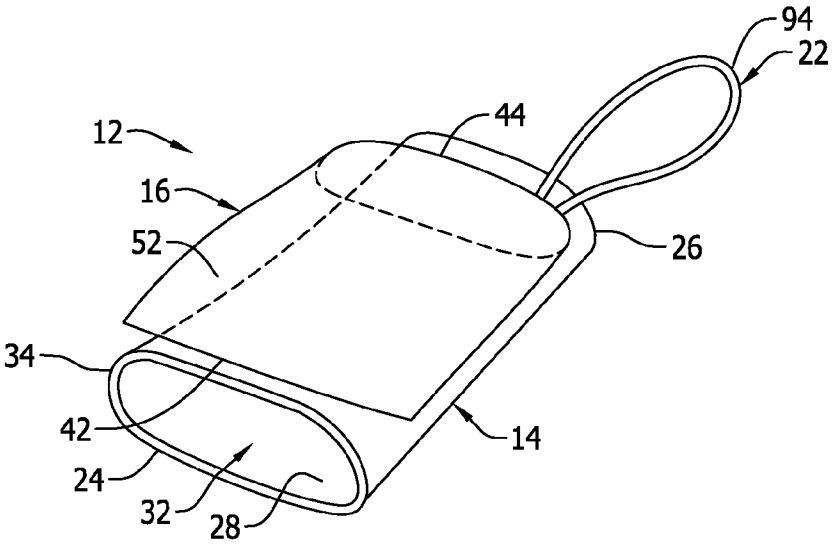
FIG. 8 is a representation of a perspective view of the signal device flipped over 180° from its position in FIG. 7.
Figure 7:
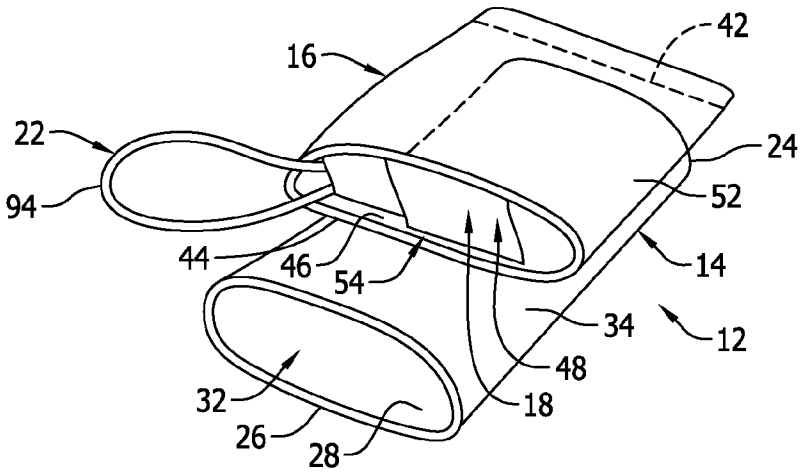
FIG. 7 is a representation of a perspective view of the signal device in its undeployed condition.

The personal signal device to be used for water sports 12 of this disclosure is basically comprised of a sleeve 14, a pouch 16, a signal flag 18 and a lanyard 22. Each of these component parts is constructed of a flexible fabric material. The component parts are constructed by sewing the fabric material in the configurations of the component parts to be described. Other equivalent materials and equivalent methods of construction could be employed in creating the personal signal device 12.

The sleeve 14 has a tubular configuration with a length dimension between a first end edge 24 and a second end edge 26 of the sleeve. The sleeve 14 has a width dimension across the sleeve when the sleeve is pressed flat. The sleeve has an interior surface 28 that surrounds an interior bore 32 through the sleeve, and an opposite exterior surface 34. The first end edge 24 of the sleeve extends completely around the interior bore 32, and the second end edge 26 of the sleeve extends completely around the interior bore 32. The sleeve interior surface 28 and the interior bore 32 are dimensioned to enable an individual to easily insert their hand through the interior bore 32 and position a portion of their arm inside the interior bore 32. The sleeve 14 could be constructed with at least a portion of the sleeve being an elastic material to cause the sleeve interior surface 28 to expand when the individual inserts their hand and arm through the interior bore 32 and to contract around their arm to securely hold the sleeve 14 to the arm of the individual.

In a variation of the sleeve, the sleeve could have a band or strip like configuration that wraps around the arm of the individual. One or more fasteners may be provided on the opposite ends of the strip between an interior surface of the strip and an exterior surface of the strip. Fasteners such as snaps, hook and loop type fasteners, or other equivalent fasteners maybe used. The fasteners would be unattached to open the tubular configuration of the sleeve 14 to the strip configuration. This would enable the strip configuration of the sleeve to be wrapped around the arm of the individual and then the fasteners reattached to secured the sleeve 14 to the arm of the individual.

The pouch 16 has a similar construction to the sleeve 14 with a generally tubular configuration. The pouch 14 has a length dimension between a first end edge 42 of the pouch and a second end edge 44 of the pouch. An interior surface 46 of the pouch extends completely around an interior bore 48 of the pouch. The pouch 16 has an exterior surface 52 opposite the interior surface 46. The length dimension of the pouch 16 corresponds substantially to the length dimension of the sleeve 14. A width dimension of the pouch 16 corresponds substantially to the width dimension of the sleeve 14 when both the pouch 16 and sleeve 14 are pressed flat. The first end edge 42 of the pouch 16 is positioned adjacent the first end edge 24 of the sleeve 14. This first end edge 42 of the pouch 16 is sewn shut across the width dimension of the pouch. The opposite second end edge 44 of the pouch 16 is left open. The pouch second end edge 44 extends completely around the interior bore 48 of the pouch and defines an opening 54 that provides access into the interior bore. The exterior surface 52 of the pouch 42 is secured to the exterior surface 34 of the sleeve 14 with the length dimension of the pouch 16 extending along the length dimension of the sleeve 14. The pouch 16 and sleeve 14 can be secured together by sewing or by other equivalent means.

The signal flag 18 is constructed of two parts, an extension part 56 and a pocket part 58. The extension part 56 and pocket part 58 are both formed from the same piece of material, as will be explained. In other equivalent embodiments the extension part 56 and the pocket part 58 could be formed from separate pieces of material.

The extension part 56 of the signal flag 18 has a general trapezoidal configuration with a first end edge 62 and an opposite second end edge 64, a first side edge 66 and an opposite second side edge 68. The extension part 56 could have other equivalent configurations. The extension part 56 is a flat sheet of material. The first end edge 62 of the extension part 56 is secured to the second end edge 44 of the pouch 16 by sewing or other equivalent means. Alternatively, the first end edge 62 of the extension part 56 could be secured to the second end edge 26 of the sleeve 14. Additionally, the signal flag extension part 56 could be an integral extension of the sleeve 14 or the pouch 16. The first end edge 62 does not extend completely around the second end edge 44 of the pouch 16, but only across about half of the second end edge 44 of the pouch 16. The trapezoidal configuration of the extension part 56 enables the width between the first side edge 66 and the second side edge 68 of the signal flag 18 to increase as a length dimension of the extension part 56 extends from the first end edge 62 to the second end edge 64. This increase in the width dimension of the extension part 56 provides the pocket part 58 with a larger width dimension which in turn increases the visibility of the pocket part 58. Depending on the intended use of the personal signal device, the first end edge 62, the second end edge 64, the first side edge 66 and the second side edge 68 could all be reinforced.

The signal flag pocket part 58 has a general rectangular configuration formed by folding over and laying flat a distal end portion of the signal flag 18 from the extension part 56. The pocket part 58 could have other equivalent configurations. The pocket part 58 has a length dimension that extends from a first end edge 72 of the pocket part to the second end edge 74 of the pocket part 58 formed by folding over the material of the signal flag 18. The pocket part 58 also has a width dimension between a first side edge 76 and an opposite second side edge 78. The pocket part first end edge 72 extends across the width dimension of the pocket part 58 and defines an opening 82 to an interior 84 of the pocket part 58. The opening 82 faces toward or is directed toward the sleeve 14. The interior 84 of the pocket part 58 is dimensioned to easily receive an individual's hand and enables the fingers of the individual's hand to be spread out, spreading out the signal flag pocket part 58. This increases the visibility of the signal flag 18.

To further increase the visibility of the signal flag 18, the signal flag could be constructed of a bright colored, fluorescent or similar material. Additionally, luminescent, reflective or other equivalent types of patches 86, 88 could be attached to the opposite sides of the pocket part 58 to further increase visibility. The patches 86, 88 could be printed on the opposite sides of the pocket part 58 or displayed on the opposite sides of the pocket part 58 in other equivalent manners.

The lanyard 22 has a length dimension between opposite first 92 and second 94 ends of the lanyard. In the drawing figures, the lanyard 22 is represented as a loop of a cord. However, it is not necessary that the lanyard 22 be formed in a loop. The first end 92 of the lanyard 22 is secured to the signal flag pocket part 58 midway along the length dimension of the second side edge 78 of the pocket part 58. In an equivalent variation of the lanyard 22, the lanyard 22 could be an integral extension of the signal flag 18.

In use of the personal signal device 12, for example by a water skier, the signal flag 18 is first positioned inside the pouch 16 by pushing both the extension part 56 and pocket part 58 of the signal flag 18 through the opening 54 in the pouch 16 defined by the pouch second end edge 44 and into the interior bore 48 of the pouch 16. As the signal flag 18 is positioned inside the pouch 16, the lanyard 22 is positioned inside the pouch 16 with the second end 94 of the lanyard being outside the pouch. This enables the water skier to easily grasp the lanyard second end 94.

The entire personal signal device 12 is then positioned on an arm of the water skier. This is done by the water skier inserting their arm through the sleeve 14 with the water skier's hand first being inserted through the first end edge 24 of the sleeve, then through the interior bore 32 of the sleeve and out of the second end edge 26 of the sleeve. Note that the sleeve second end edge 26 and the adjacent opening 54 in the pouch 16 defined by the second end edge 44 of the pouch are both positioned toward the hand of the arm to which the personal signal device 12 is attached.

The personal signal device 12 when attached to the water skier's arm as described above, is compactly positioned on the arm and is not a significant obstruction to the water skier when water skiing. The sleeve 14, the pouch 16, the signal flag 18 and the lanyard 22 all being constructed from flexible fabric material contribute to the comfort of the water skier wearing the personal signal device 21.

Should the water skier fall while water skiing, the lanyard 22 can be quickly grabbed by the free hand of the water skier and pulled from the pouch 16. This causes the lanyard 22 to pull the signal flag 18 from the pouch 16.

With the signal flag 18 now pulled from the pouch 16, the water skier can insert their hand on the arm to which the personal signal device 12 is attached through the pocket opening 82 and into the interior 84 of the signal flag pocket part 58. The water skier can then spread out the fingers of the hand inserted into the pocket part 58 to expand the pocket part and make it more visible. The water skier can then wave their hand inserted into the pocket part 58 over their head, providing a visual indication to boats or other skiers in the area of the position of the water skier down in the water.

While the personal signal device is described above as being used by a water skier, the signal device can be used by any participant in water sports. The personal signal device could be used by a swimmer in a swimming pool to attract the attention of a lifeguard if the swimmer is having trouble. The personal signal device could also be used by a person that is tubing behind a boat, a person that is operating a wave runner, or a person that is participating in any type of water sport or water involved activity. It should be understood that the personal signal device of this disclosure should not be interpreted as only being usable by a water skier.

Furthermore, it should be understood that the personal signal device of this disclosure could be used by an individual in any environment and in any situation where it is desirable for the individual to have a personal signal device worn comfortably on their arm that can be easily and quickly manually deploy to signal a location of the individual. Use of the personal signal device is not limited to water related activities.

As various modifications could be made in the construction of the personal signal device and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

What is claimed:

1. A personal signal device comprising:

a sleeve that is configured to be worn on an arm of an individual;

a pouch attached to the sleeve;

a signal flag stowed inside the pouch, the signal flag being manually removable from the pouch to display the signal flag outside the pouch;

a pocket part on the signal flag, the pocket part being configured to receive a hand of an individual using the device inserted inside an interior of the pocket part; and, an opening to an interior of the pocket part, the opening facing toward the sleeve, the interior of the pocket part being dimensioned to receive an individual's hand and enable fingers of the individual's hand to be spread out and thereby spreading out the pocket part on the signal flag.

2. The device of claim 1, further comprising:

the sleeve, the pouch and the signal flag each being constructed of a flexible, fabric material.

3. The device of claim 1, further comprising:

the sleeve, the pouch and the signal flag all being attached together.

4. The device of claim 1, further comprising:

a lanyard attached to the signal flag, the lanyard being at least partially stowed inside the pouch and partially outside the pouch, the lanyard being manually removable from the pouch to manually remove the signal flag from the pouch in response to manually removing the lanyard from the pouch.

5. The device of claim 1, further comprising:

the pocket part having a first reflective patch on one side of the pocket part and a second reflective patch on a second, opposite side of the pocket part.

6. The device of claim 1, further comprising:

an extension part on the signal flag, the extension part being positioned extending between the pocket part on the signal flag and the sleeve and spacing the pocket part from the sleeve.

7. The device of claim 1, further comprising:

the pocket part having a length dimension between a first end edge and an opposite second end edge of the pocket part, and the pocket part having a width dimension between a first side edge and an opposite second side edge of the pocket part, the pocket part having an opening along the first end edge of the pocket part that provides access to the interior of the pocket part, the opening facing toward and being directed toward the sleeve.

8. The device of claim 7, further comprising:

the extension part having a length dimension between a first end edge and an opposite second end edge of the extension part, and the extension part having a width dimension between a first side edge and an opposite second side edge of the extension part, the first end edge of the extension part being attached to the sleeve and the pouch and the second end edge of the extension part being attached to the pocket part.

9. The device of claim 8, further comprising:

the pocket part and the extension part of the signal flag can both be laid flat.

10. A personal signal device comprising:

a sleeve having a tubular configuration constructed of a flexible, fabric material, the sleeve having a length dimension between a first end edge and an opposite second end edge of the sleeve, the sleeve having an interior bore extending through the sleeve between the first end edge and the second end edge of the sleeve, the interior bore being surrounded by an interior surface of the sleeve, the sleeve having an exterior surface opposite the interior surface, the sleeve first end edge extending completely around the interior bore and the sleeve second end edge extending completely around the interior bore;

a pouch having a tubular configuration constructed of a flexible, fabric material, the pouch having a length dimension between a first end edge of pouch and an opposite second end edge of the pouch, the first end edge of the pouch being closed, the pouch having an interior bore extending into the pouch from the second end edge of the pouch and to the first end edge of the pouch, the interior bore being surrounded by an interior surface of the pouch, the second end edge of the pouch extending completely around the interior bore of the pouch, the exterior surface of the pouch being attached to the exterior surface of the sleeve;

a signal flag constructed of a flexible, fabric material, the signal flag being attached to the sleeve and to the pouch, the signal flag being stowed inside the interior bore of the pouch, the signal flame being manually removable from the interior bore of the pouch to display the signal flag outside the pouch;

a pocket part on the signal flag, the pocket part being configured to receive a hand of an individual using the device inserted inside an interior of the pocket part; and, an opening to an interior of the pocket part, the opening facing toward the sleeve, the interior of the pocket part being dimensioned to receive an individual's hand and enable fingers of the individual's hand to be spread out and thereby spreading out the pocket part on the signal flag.

11. The device of claim 10, further comprising:

a lanyard attached to the signal flag, the lanyard being at least partially stowed inside the pouch and partially outside the pouch, the lanyard being manually removable from the pouch to manually remove the signal flag from the pouch in response to manually removing the lanyard from the pouch.

12. The device of claim 10, further comprising:

the pocket part having a first reflective patch on one side of the pocket part and a second reflective patch on a second, opposite side of the pocket part.

13. The device of claim 10, further comprising:

an extension part on the signal flag, the extension part being positioned extending between the pocket part on the signal flag and the sleeve and spacing the pocket part from the sleeve.

14. The device of claim 10, further comprising:

the pocket part having a length dimension between a first end edge and an opposite second end edge of the pocket part, and the pocket part having a width dimension between a first side edge and an opposite second side edge of the pocket part, the pocket part having an opening along the first end edge of the pocket part that provides access to the interior of the pocket part, the opening facing toward and being directed toward the sleeve.

15. The device of claim 14, further comprising:

the extension part having a length dimension between a first end edge and an opposite second end edge of the extension part, and the extension part having a width dimension between a first side edge and an opposite second side edge of the extension part, the first end edge of the extension part being attached to the sleeve and the pouch and the second end edge of the extension part being attached to the pocket part.

16. The device of claim 15, further comprising:

the pocket part and the extension part of the signal flag can both be laid flat.

17. A method of signaling a location of a water sport participant in water, the method comprising:

positioning a signaling device on an arm of the water sport participant with the signaling device being a pouch containing signal flag;

manually the signal flag from the pouch;

after manually removing the signal flag from the pouch, positioning a pocket on the signal flag on a hand of the water sort participant; and, spreading out fingers on the hand of the water sport participant and thereby spreading out the pocket on the signal flag.

* * * * *